US007518950B2

(12) United States Patent
Treviranus et al.

(10) Patent No.: US 7,518,950 B2
(45) Date of Patent: Apr. 14, 2009

(54) METHOD AND APPARATUS FOR DOWNLINK COMMUNICATION

(75) Inventors: Joachim Treviranus, Winsen Aller (DE); Henning Doerge, Bröckel (DE); Marc Kurella, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/386,622

(22) Filed: Mar. 22, 2006

(65) Prior Publication Data

US 2006/0225920 A1 Oct. 12, 2006

Related U.S. Application Data

(60) Provisional application No. 60/665,823, filed on Mar. 28, 2005.

(51) Int. Cl.
*E21B 47/18* (2006.01)

(52) U.S. Cl. ..... 367/83; 340/854.3; 175/45; 367/82

(58) Field of Classification Search ..... 367/82, 367/83, 89; 340/854.3; 175/45
See application file for complete search history.

(56) References Cited

U.S. PATENT DOCUMENTS

| | | | |
|---|---|---|---|
| 2,901,685 | A | 8/1959 | Alder |
| 2,964,116 | A | 12/1960 | Peterson |
| 2,973,505 | A | 2/1961 | Johannesen |
| 3,065,416 | A | 11/1962 | Jeter |
| 3,302,457 | A | 2/1967 | Mayes |
| 3,309,656 | A | 3/1967 | Godbey |
| 3,693,428 | A | 9/1972 | LePeuvedic et al. |
| 3,713,089 | A | 1/1973 | Clacomb |
| 3,732,728 | A | 5/1973 | Fitzpatrick |
| 3,736,558 | A | 5/1973 | Cubberly, Jr. |
| 3,737,843 | A | 6/1973 | LePeuvedic et al. |
| 3,739,331 | A | 6/1973 | Godbey et al. |
| 3,764,968 | A | 10/1973 | Anderson |
| 3,764,969 | A | 10/1973 | Cubberly, Jr. |
| 3,764,970 | A | 10/1973 | Manning |
| 3,770,006 | A | 11/1973 | Sexton et al. |
| 3,800,277 | A | 3/1974 | Patton et al. |
| 3,958,217 | A | 5/1976 | Spinnler |
| 3,964,556 | A | 6/1976 | Gearhart et al. |

(Continued)

FOREIGN PATENT DOCUMENTS

| | | |
|---|---|---|
| GB | 2096372 | 10/1982 |

(Continued)

*Primary Examiner*—Albert K Wong
(74) *Attorney, Agent, or Firm*—Madan Mossman & Sriram PC

(57) ABSTRACT

The present invention provides a method and system in which signals from the surface are sent by changing flow rate of the drilling fluid supplied to the drill string during drilling of a wellbore. The signals are sent based on a fixed or dynamic time period schemes so that the sent signals cross a threshold value in a known manner. A detector measures the changes in the flow rate. A controller downhole determines the number of times a downhole parameter, such as voltage, relating to the changes in the flow rate crosses a predefined threshold value. Based on the number of the crossings and the timing of such crossings, signals are assigned to commands. The controller controls or operates a steering device based on the commands.

22 Claims, 8 Drawing Sheets

U.S. PATENT DOCUMENTS

| | | | |
|---|---|---|---|
| 3,971,926 | A | 7/1976 | Gau et al. |
| 3,982,224 | A | 9/1976 | Patton |
| 4,007,805 | A | 2/1977 | Reber |
| RE29,734 | E | 8/1978 | Manning |
| RE30,055 | E | 7/1979 | Claycomb |
| 4,166,979 | A | 9/1979 | Waggener |
| 4,351,037 | A | 9/1982 | Scherbatskoy |
| 4,461,359 | A | 7/1984 | Jones, Jr. et al. |
| 4,462,469 | A | 7/1984 | Brown |
| 4,499,563 | A | 2/1985 | Jurgens |
| 4,515,225 | A | 5/1985 | Dailey |
| 4,628,495 | A | 12/1986 | Peppers et al. |
| 4,630,244 | A | 12/1986 | Larronde |
| 4,675,852 | A | 6/1987 | Russell et al. |
| RE32,463 | E | 7/1987 | Westlake et al. |
| 4,686,658 | A | 8/1987 | Davison |
| 4,698,794 | A | 10/1987 | Kruger et al. |
| 4,703,461 | A | 10/1987 | Kotlyar |
| 4,734,892 | A | 3/1988 | Kotlylar et al. |
| 4,771,408 | A | 9/1988 | Kotlyar |
| 4,785,300 | A | 11/1988 | Chin et al. |
| 4,790,393 | A | 12/1988 | Larronde et al. |
| 4,796,699 | A | 1/1989 | Upchurch |
| 4,847,815 | A | 7/1989 | Malone |
| 4,914,637 | A | 4/1990 | Goodsman |
| 4,915,168 | A | 4/1990 | Upchurch |
| 4,953,595 | A | 9/1990 | Kotlyar |
| 4,956,823 | A | 9/1990 | Russell et al. |
| 4,982,811 | A | 1/1991 | Hardee |
| 5,034,929 | A | 7/1991 | Cobern et al. |
| 5,065,825 | A | 11/1991 | Bardin et al. |
| 5,079,750 | A | 1/1992 | Scherbatckoy |
| 5,113,379 | A | 5/1992 | Scherbatskoy |
| 5,115,415 | A | 5/1992 | Mumby et al. |
| 5,119,344 | A | 6/1992 | Innes |
| 5,182,730 | A | 1/1993 | Scherbatskoy |
| 5,182,731 | A | 1/1993 | Hoelscher et al. |
| 5,189,645 | A | 2/1993 | Innes |
| 5,215,152 | A | 6/1993 | Duckworth |
| 5,249,161 | A | 9/1993 | Jones et al. |
| 5,318,409 | A | 6/1994 | London et al. |
| 5,357,483 | A | 10/1994 | Innes |
| 5,375,098 | A | 12/1994 | Malone et al. |
| 5,691,712 | A | 11/1997 | Meek et al. |
| 5,740,126 | A | 4/1998 | Chin et al. |
| 5,787,052 | A | 7/1998 | Gardner et al. |
| 5,799,733 | A | 9/1998 | Ringgenberg et al. |
| 5,812,068 | A | 9/1998 | Wisler et al. |
| 5,834,929 | A | 11/1998 | Dietz |
| 5,963,138 | A | 10/1999 | Gruenhagen |
| 6,089,332 | A | 7/2000 | Barr et al. |
| 6,105,690 | A | 8/2000 | Biglin, Jr. et al. |
| 6,219,301 | B1 | 4/2001 | Moriarty |
| 6,289,998 | B1 | 9/2001 | Krueger et al. |
| 6,714,138 | B1 | 3/2004 | Turner et al. |
| 7,222,681 | B2 | 5/2007 | Jones et al. |
| 2003/0016164 | A1 | 1/2003 | Finke et al. |
| 2005/0056465 | A1 | 3/2005 | Virally et al. |
| 2005/0209782 | A1* | 9/2005 | Moriarty ..... 702/6 |

FOREIGN PATENT DOCUMENTS

| | | | |
|---|---|---|---|
| GB | 2156405 | A | 10/1985 |
| WO | WO2004/062081 | | 7/2004 |

* cited by examiner

500

510

| Command | Previous mode | Operational mode |
|---|---|---|
| Continue | [new electronics] | "Vertical Drilling Mode(100% Drop Force)" |
| | [all modes except "Ribs off"] | [mode used before flow off] |
| | "Ribs off" | [last mode used before "Ribs off"] |
| Ribs off | [all modes] | [Ribs off modes] |
| Continue Reduced Force (on/off) | "Vertical Drilling Mode (max.100% Drop Force)" | "Vertical Drilling Mode (reduced max. Drop Force)" |
| | "Kick Off Mode (100% Build Force)" | "Kick Off Mode (rebuild Build Force)" |
| | "Inclination Hold Mode" | "Inclination Hold Mode" |
| | "Inclination Hold Mode (reduced Walk Force left)" | "Inclination Hold Mode (reduced Walk Force left)" |
| | "Inclination Hold Mode (max. Walk Force right)" | "Inclination Hold Mode (reduced Walk Force right)" |
| | "Vertical Drilling Mode (reduced max. Drop Force)" | "Vertical Drilling Mode (100% Drop Force)" |
| | "Kick Off Mode (reduced Build Force)" | "Kick Off Mode (100% Build Force) |
| | "Inclination Hold Mode (reduced Walk Force left)" | "Inclination Hold Mode (Walk Force left)" |

520 530

A B C

FIG. 5

| D | E | F |
|---|---|---|
| Add/Remove walk force left | "Inclination Hold Mode" | "Inclination Hold Mode (Walk Force left)" |
| | "Inclination Hold Mode (Walk Force left)" | "Inclination Hold Mode" |
| | "Inclination Hold Mode (reduced Walk Force left)" | "Inclination Hold Mode" |
| | "Inclination Hold Mode (Walk Force right)" | "Inclination Hold Mode (Walk Force left)" |
| | "Inclination Hold Mode (reduced Walk Force right)" | "Inclination Hold Mode (Walk Force left)" |
| | [all other modes] | "Inclination Hold Mode (Walk Force left)" [Lock Target Inclination] |
| Add/Remove walk force right | "Inclination Hold Mode" | "Inclination Hold Mode (Walk Force right)" |
| | "Inclination Hold Mode (Walk Force right)" | "Inclination Hold Mode" |
| | "Inclination Hold Mode (reduced Walk Force right)" | "Inclination Hold Mode" |
| | "Inclination Hold Mode (Walk Force left)" | "Inclination Hold Mode (Walk Force right)" |
| | "Inclination Hold Mode (reduced Walk Force left)" | "Inclination Hold Mode (Walk Force right)" |
| | [all other modes] | "Inclination Hold Mode (Walk Force right)" [Lock Target Inclination] |
| Kick off | [all modes] | "Kick off Mode" [Reset Target Direction] |
| Hold Inclination | [all modes] | "Inclination Hold Mode" [Reset Target Direction] |
| Vertical Drilling | all modes | "Vertical Drilling Mode(100% Drop Force)" |

FIG. 5 (Continued)

METHOD AND APPARATUS FOR DOWNLINK COMMUNICATION

CROSS-REFERENCE TO RELATED APPLICATIONS

This application takes priority from U.S. Provisional Patent Application Ser. No. 60/665,823, filed on Mar. 28, 2005.

BACKGROUND OF THE INVENTION

1. Field of the Invention

This invention relates generally to data and signal communication methods between surface and a downhole tool in a wellbore and more particularly to communication from the surface to a downhole tool by utilizing mudflow variations.

2. Description of the Related Art

Wellbores or boreholes are drilled in the earth formation for the production of hydrocarbons (oil and gas) utilizing a rig structure (land or offshore) and a drill string that includes a tubing (joined pipes or a coiled tubing) and a drilling assembly (also referred to as a bottom hole assembly or "BHA"). The drilling assembly carries a drill bit that is rotated by a motor at the surface and/or by a drilling motor or mud motor carried by the drilling assembly. The drilling assembly also carries a variety of downhole sensors usually referred to as the measurement-while-drilling ("MWD") sensors or tools. Drilling fluid or mud is pumped by mud pumps at the surface into the drill string, which after discharging at the drill bit returns to the surface via an annulus between the drill string and the borehole walls. The downhole tools in the BHA perform a variety of functions including drilling the wellbore along a desired well path that may include vertical sections, straight inclined sections and curved sections. Signals are sent from the surface to the downhole tools to cause the downhole tools to operate in particular manners. Downhole tools also send data and signals to the surface relating to a variety of downhole conditions and formation parameters.

In one method, signals are sent as encoded signals from the surface to the downhole tools using the drilling fluid column in the wellbore as the transmission medium. Such signals are usually sent in the form of sequences of pressure pulses by a pulser at the surface or by changing the drilling fluid flow rate at the surface. The changes in the flow rate are sensed or measured at a suitable downhole location by one or more downhole detectors, such as flow meters and pressure sensors, and then deciphered or decoded by a downhole controller. Mud pulse telemetry schemes typically utilized tend to be complex and consume extensive amount of time to transmit signals. Also, majority of the current down linking methods where fluid flow is varied utilize rig site apparatus that requires relatively precise controls of the fluid flow variations and special downhole set ups to transmit complex data.

However, many of the wells or portions thereof can be drilled by utilizing a limited number of commands or signals sent from the surface to the downhole tools, including implementing automated drilling. Consequently, a simplified telemetry method and system can be used to transmit signals to the downhole tool. Thus, there is a need for an improved method and system for transmitting signals from the surface, detecting the transmitted signals downhole and utilizing the detected signals to effect various operations of the downhole tools during drilling of wellbores.

SUMMARY OF THE INVENTION

The present invention provides down linking methods and systems that utilize surface sent commands to operate or control downhole tools (such as a drilling assembly, steering mechanism, MWD sensors etc.). In one aspect, signals from the surface are sent by altering the fluid flow rate of the fluid flowing (circulating or pumped) in a wellbore. The signals may be sent utilizing fixed or dynamic time period schemes. Flow rate changes are detected downhole to determine the surface sent signals. In one aspect, the method determines the signals sent from the surface based on the number of times the flow rate crosses a threshold. In another aspect, the method also utilizes the time periods associated with the crossings to determine the signals. In one aspect, the end of a signal may be defined by a period of constant flow rate. In another aspect, each determined signal may correspond to a command that is stored in a memory downhole. The flow rate at the surface may be changed automatically by a controller that controls the mud pumps at the surface or by controlling a fluid flow control device. The flow rate changes downhole may be detected by any suitable detector, such as a flow meter, pressure sensor, etc.

In another aspect, the invention provides a tool that includes a flow measurement system that includes a flow measuring device, such as a pressure sensor or a flow meter, such as turbine driven alternator that generates a voltage signal corresponding to the measured flow rate. A controller in the downhole tool coupled to the flow meter determines the number of crossings of the fluid flow relative to a threshold and associated time periods and determines the nature of the signals sent from the surface. The downhole tool contains information in the form of a matrix or table which assigns each command to a function or operation to be performed by the downhole tool. The controller correlates the detected signals to their assigned commands and operate the tool in response to the commands.

In another aspect, a sample set of commands may be utilized to achieve drilling of a wellbore or a portion thereof. For directional drilling, as an example, target values may be set for parameters relating to azimuth, tangent and inclination. As an example, to lock an azimuth, direction may be adjusted to the desired direction from the surface. When the transmitted data from the downhole tool indicates the desired adjustment of the downhole tool, the direction may be locked by the surface command. This same procedure may be applied to set other parameters or aspects of the downhole tool, such as target inclination. Also, commands may be used to control the operation of a steering device downhole to drill various sections of a wellbore, including vertical, curved, straight tangent, and drop off sections. The command also may be used to operate other downhole tools and sensors.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the embodiments, taken in conjunction with the accompanying drawing; wherein:

FIG. 5 is a table showing an example of acts that may be performed by the downhole tools in response to certain commands from the surface to drill at least a portion of a wellbore.

DETAILED DESCRIPTION OF THE INVENTION

Figure 1:
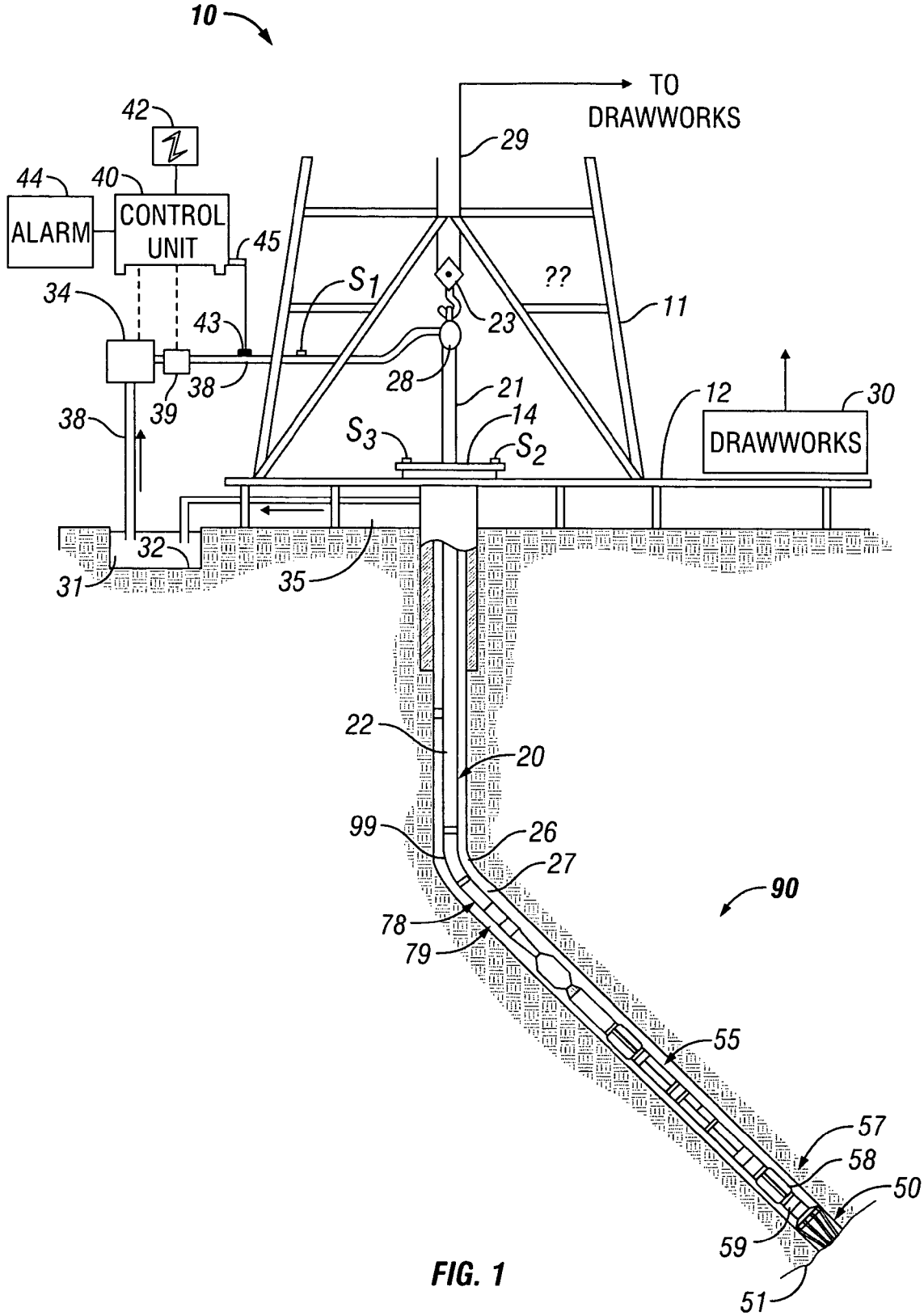
FIG. 1 shows a schematic illustration of a drilling system that utilizes one embodiment of the present invention.

FIG. 1 shows a schematic diagram of a drilling system 10 in which a drillstring 20 carrying a drilling assembly 90 or BHA is conveyed in a "wellbore" or "borehole" 26 for drilling the wellbore. The drilling system 10 may include a conventional derrick 11 erected on a platform or floor 12 which supports a rotary table 14 that is rotated by a prime mover such as an electric motor (not shown) at a desired rotational speed. The drillstring 20 includes a metallic tubing 22 (a drill pipe generally made by joining metallic pipe sections or a coiled tubing) that extends downward from the surface into the borehole 26. The drill string 20 is pushed into the wellbore 26 to effect drilling of the wellbore. A drill bit 50 attached to the end of the drilling assembly 90 breaks up the geological formations when it is rotated to drill the borehole 26. The drillstring 20 is coupled to a drawworks 30 via a Kelly joint 21, swivel 28, and line 29 through a pulley 23. During drilling operations, the drawworks 30 is operated to control the weight on bit, which is a parameter that affects the rate of penetration.

During drilling operations, a suitable drilling fluid 31 (also known as "mud") from a mud pit (source) 32 is circulated under pressure through a channel in the drillstring 20 by one or more mud pumps 34. The drilling fluid 31 passes from the mud pumps 34 into the drillstring 20 via a desurger (not shown), fluid line 38 and Kelly joint 21. The drilling fluid 31 is discharged at the borehole bottom through an opening in the drill bit 50. The drilling fluid 31 then circulates uphole through the annular space 27 (annulus) between the drillstring 20 and the borehole 26 and returns to the mud pit 32 via a return line 35. The drilling fluid acts to lubricate the drill bit 50 and to carry borehole cuttings or chips to the surface.

A sensor or device $S_1$, such as a flow meter, typically placed in the line 38 provides information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20. The drill bit 50 may be rotated by rotating the drill pipe 22, or a downhole motor 55 (mud motor) disposed in the drilling assembly 90 or by both by rotating the drill pipe 22 and using the mud motor 55.

In the embodiment of FIG. 1, the mud motor 55 is shown coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 provides support to the drilling assembly from the radial and axial forces of the drill bit. A stabilizer 58 coupled to the bearing assembly 57 acts as a centralizer for the lowermost portion of the mud motor assembly.

In one embodiment of the invention, a drilling sensor module 59 is placed near the drill bit 50. The drilling sensor module 59 contains sensors, circuitry and processing software and algorithms relating to the dynamic drilling parameters. Such parameters typically include bit bounce, stick-slip of the drilling assembly, backward rotation, torque, shocks, borehole and annulus pressure, acceleration measurements and other measurements of the drill bit condition.

A telemetry or communication tool 99 (or module) is provided near an upper end of the drilling assembly 90. The communication system 99, a power unit 78 and measurement while drilling ("MWD") tools 79 are all connected in tandem with the drillstring 20. Flex subs, for example, are used for integrating the MWD tools 79 into the drilling assembly 90. The MWD and other sensors in the drilling assembly 90 make various measurements including pressure, temperature, drilling parameter measurements, resistivity, acoustic, nuclear magnetic resonance, drilling direction measurements, etc. while the borehole 26 is being drilled. The data or signals from the various sensors carried by the drilling assembly 90 are processed and the signals to be transmitted to the surface are provided to the downhole telemetry system or tool 99.

The telemetry tool 99 obtains the signals from the downhole sensors and transmits such signals to the surface. One or more sensors 43 at the surface receive the downhole sent signals and provide the received signals to a surface controller, processor or control unit 40 for further processing according to programmed instructions associated with the controller 40. The surface control unit 40 typically includes one or more computers or microprocessor-based processing units, memory for storing programs or models and data, a recorder for recording data, and other peripherals.

In one embodiment, the system 10 may be programmed to automatically control the pumps or any other suitable flow control device 39 to change the fluid flow rate at the surface or the driller may operate the mud pumps 34 to affect the desired fluid flow rate changes in the drilling fluid being pumped into the drill string. In this manner, encoded signals from the surface are sent downhole by altering the flow of the drilling fluid at the surface and by controlling the time periods associated with the changes in the flow rates. In one aspect, to change the fluid flow rate, the control unit 40 may be coupled to and controls the pumps 34. The control unit contains programmed instructions to operate and control the pumps 34 by setting the pump speed so that the fluid being pumped downhole will exhibit the flow characteristics according to a selected flow rate scheme, certain examples of which are shown and discussed in reference to FIGS. 3 and 4 below. In another aspect, the control unit 40 may be coupled to a suitable flow control device 39 in line 38 to alter the rate of flow of the drilling fluid in line 38 so that the fluid at the downhole location will exhibit the flow characteristics according to the selected scheme. The flow control device 39 may be any suitable device, including a fluid bypass device, wherein a valve controls the flow of the drilling fluid from the line 38 to a bypass line, thereby creating pressure pulses in the drilling fluid that can be detected downhole. A detector, such as a flow meter or pressure sensor associated with the downhole telemetry tool 99, detects changes in the flow rate downhole and a processor in the telemetry tool 99 determines the nature of the signals that correspond to the detected fluid flow variation.

Still referring to FIG. 1, the surface control unit 40 also receives signals from other downhole sensors and devices and signals from surface sensors 43, $S_1$-$S_3$ and other sensors used in the system 10 and processes such signals according to programmed instructions provided to the surface control unit 40. The surface control unit 40 displays desired drilling parameters and other information on a display unit 42 utilized by an operator or driller to control the drilling operations.

Figure 2:
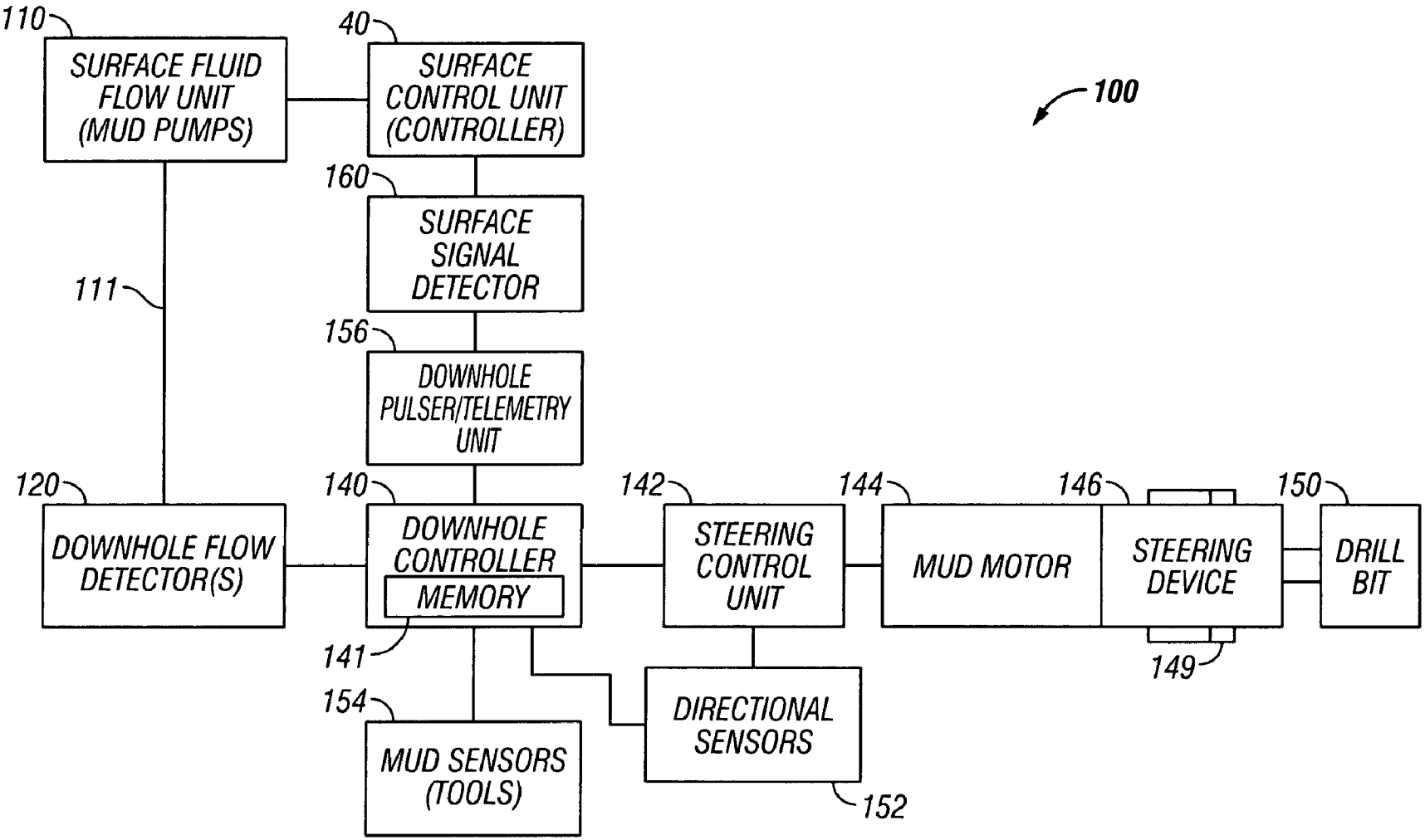
FIG. 2 shows a functional block diagram of a telemetry system according to one embodiment of the telemetry system of the present invention.

FIG. 2 shows a functional block diagram 100 of a telemetry system 100 according to one embodiment of the present invention that may be utilized during drilling of wellbores. The system 100 includes the surface control unit 40 and a surface mud flow unit or device 110, which may be the mud pumps 34 (FIG. 1) or another suitable device that can alter the flow rate of the mud 111 being pumped downhole. The mud 111 flows through the drill pipe and into the drilling assembly 90 (FIG. 1). The drilling assembly 90 includes a downhole fluid flow measuring device or detector 120, such as a flow meter or a pressure sensor. A turbine drive and an alternator or any other suitable device known in the art may be utilized as the flow measuring device 120. The detector 120 detects the changes in the flow rate downhole. In one aspect, the detector measures the pressure or flow rate downhole and provides a signal (such as voltage) corresponding to the measured flow rate. A downhole controller (that includes a processor) 140 coupled to the detector 120 determines the number of crossings as described below in reference to FIGS. 3 and 4 to determine the particular command sent from the surface. The downhole controller also determines signal or time periods of fluid flow, such as constant flow rates associated with the crossings. The downhole controller 140, utilizing the crossings and time period information, deciphers the signals sent from the surface. The downhole controller 140 includes one or more memory devices 141 which store programs and a list of commands that correspond to the signals sent from the surface. The downhole controller also determines signal or time periods of fluid flow, such as constant flow rates associated with the crossings. It also includes the actions to be performed by the downhole tools in response to the commands.

The downhole tool 90 also may include a steering control unit 142 that controls the steering device 146 that causes the drill bit 150 to drill the wellbore in the desired direction. In the example of FIG. 2, the downhole tool includes a mud motor 144 that rotates the drill bit 150 and a steering device 146 disposed near the drill bit 150. The steering device 146 includes a plurality of force application members or ribs 149 that can be independently extended radially outward from the tool to selectively apply force on the wellbore wall. The independently controlled ribs 149 can apply the same or a different amount of force to direct the drill bit along any desired direction and thus to drill the wellbore along any desired wellbore path. Directional sensors 152 provide information relating to the azimuth and inclination of the drilling tool or assembly 90. The controller 140 also is coupled to one or more measurements-while-drilling sensors and can control functions of such sensors in response to the downlink signals sent from the surface. A downhole pulser 156 sends data and information to the surface relating to the downhole measurements. The surface detectors 160 detect the signals sent from downhole and provide signals corresponding to such signals to the surface controller 40. The signals sent from downhole may include instructions to change the flow rates at the surface or to send signals using a particular telemetry scheme. Examples of the telemetry schemes utilized by the system 100 are described below with respect to FIGS. 3-4.

Figure 3:
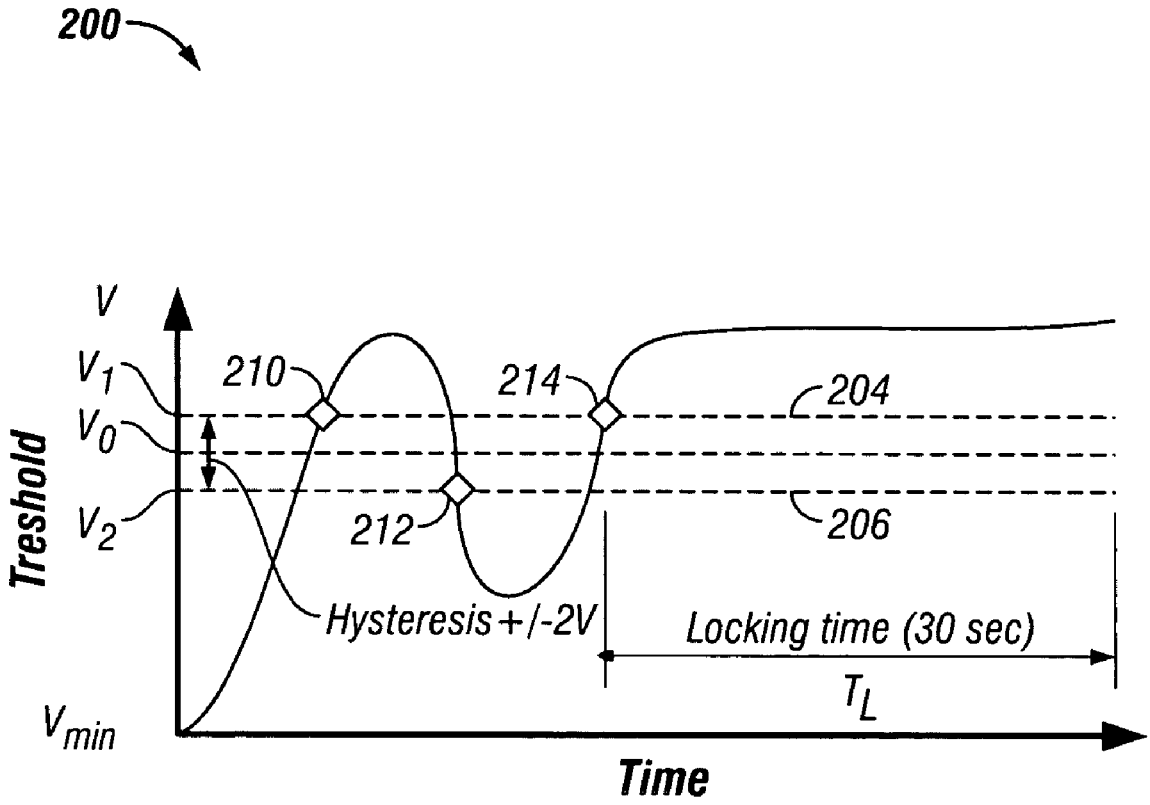
FIG. 3 shows a graph of a parameter (voltage) versus time that shows a principle utilized for sending and detecting pulses according to one aspect of the invention.

FIG. 3 shows a graph 200 of a downhole measured parameter versus time in response to mud flow rate changes effected at the surface. The graph 200 shows a principle or method of determining or decoding the signals sent from the surface. The detector 120 (FIG. 2) of the downhole telemetry tool measures the variations in the flow rate and provides a signal, such as voltage ("V"), corresponding to the measured flow rate. Graph 200 shows the voltage response ("V") along the vertical axis versus time ("T") along the horizontal axis. A threshold value Vo with a range $V_1$-$V_2$ for the parameter V is predefined and stored in the memory 142 associated with the downhole telemetry controller 140. The range $V_1$-$V_2$ may be defined in a manner that will account for hysterisis inherently present for the measurements relating to the changes in the fluid flow rates. In the example of FIG. 3, each time the voltage level crosses either the upper limit 204 ($V_1$) or the lower limit 206 ($V_2$), the downhole controller 140 makes a count. Thus, in the pulse sequence example of FIG. 3, the downhole control unit 140 will make a total of three counts, one count at each of the points 210, 212 and 214. Alternatively, a single threshold level or value, such as $V_0$ may be defined so that the controller makes a count each time the measured value crosses the threshold. Additionally, more than two thresholds may also be defined for the count rate.

A pulse sequence followed by a constant flow for a selected time period (locking time $T_L$; for example 30 seconds as shown in FIG. 3) may be used to define the end of the pulse sequence sent from the surface in the form of flow changes. In the example of FIG. 2, once the downhole controller receives the information about the locking time, it then corresponds the count rate, such as the three counts shown in FIG. 3, to a particular command signal for such a count rate that is stored in a downhole memory. Thus, a unique command can be assigned to a unique count rate.

In one aspect, the present invention utilizes a relatively small number of commands to affect certain drilling operations. For example, to drill a wellbore or a portion thereof a limited number of commands may be sufficient to affect closed loop drilling of the wellbore along a relatively complex well path by utilizing the apparatus and methods described herein. In one aspect, as an example, the commands to a steering device may be as follows: (1) Continue; (2) Ribs off (no force by the force application device); (3) Continue with reduced force; (4) Add or remove walk force—left; (5) Add or remove walk force—right (6) Kick off; (7) Hold inclination; and (8) Vertical drilling mode (100% drop force). Also, the commands may be utilized to operate other downhole tools and sensors. For example, a command may be used to measure a parameter of interest by a particular sensor or tool, activate or deactivate a sensor or tool; turn on or turn off a tool or a sensor; etc.

Figure 4:
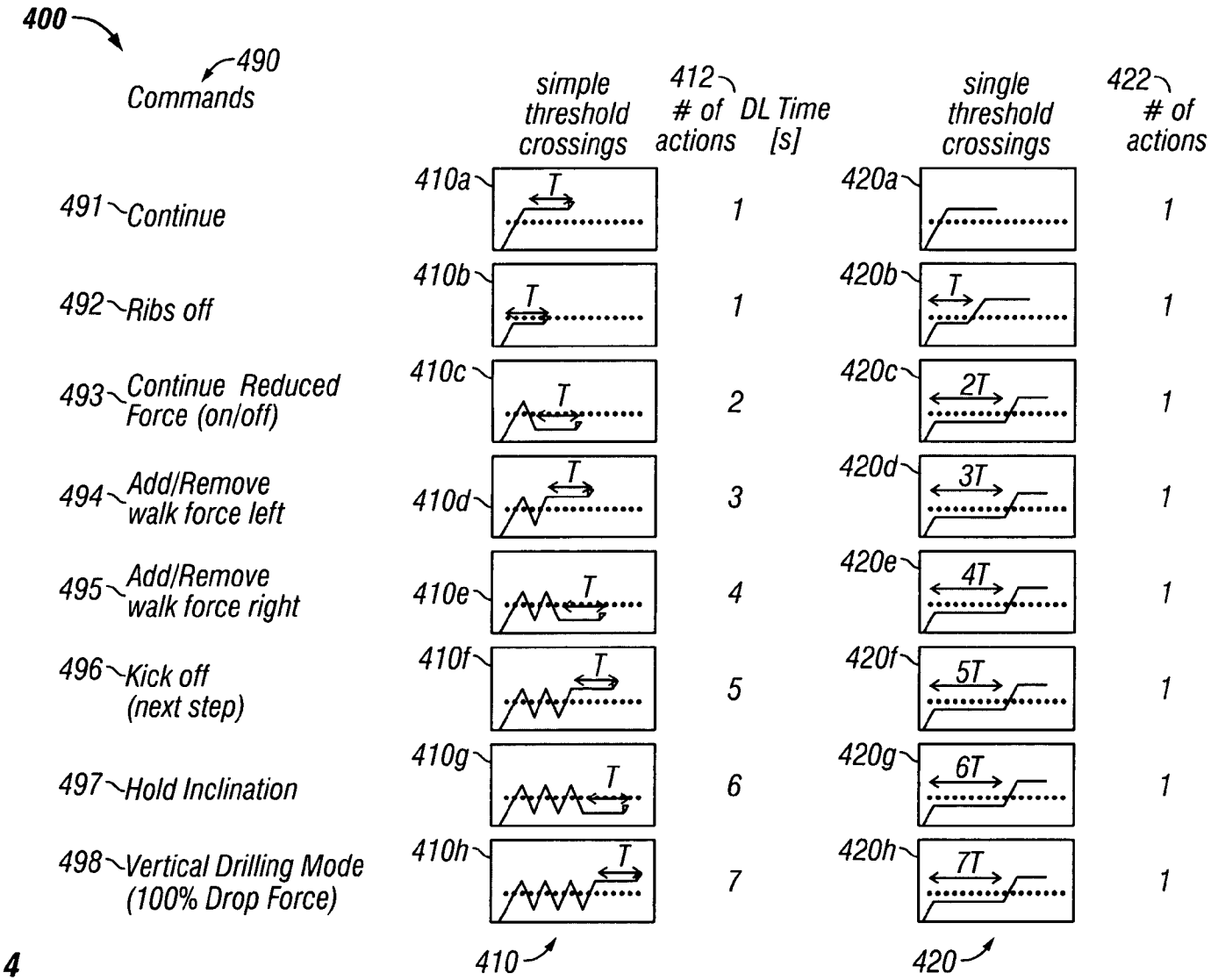
FIG. 4 shows certain examples of the flow sequences that may be utilized to implement the methods of the present invention.
Figure 4:
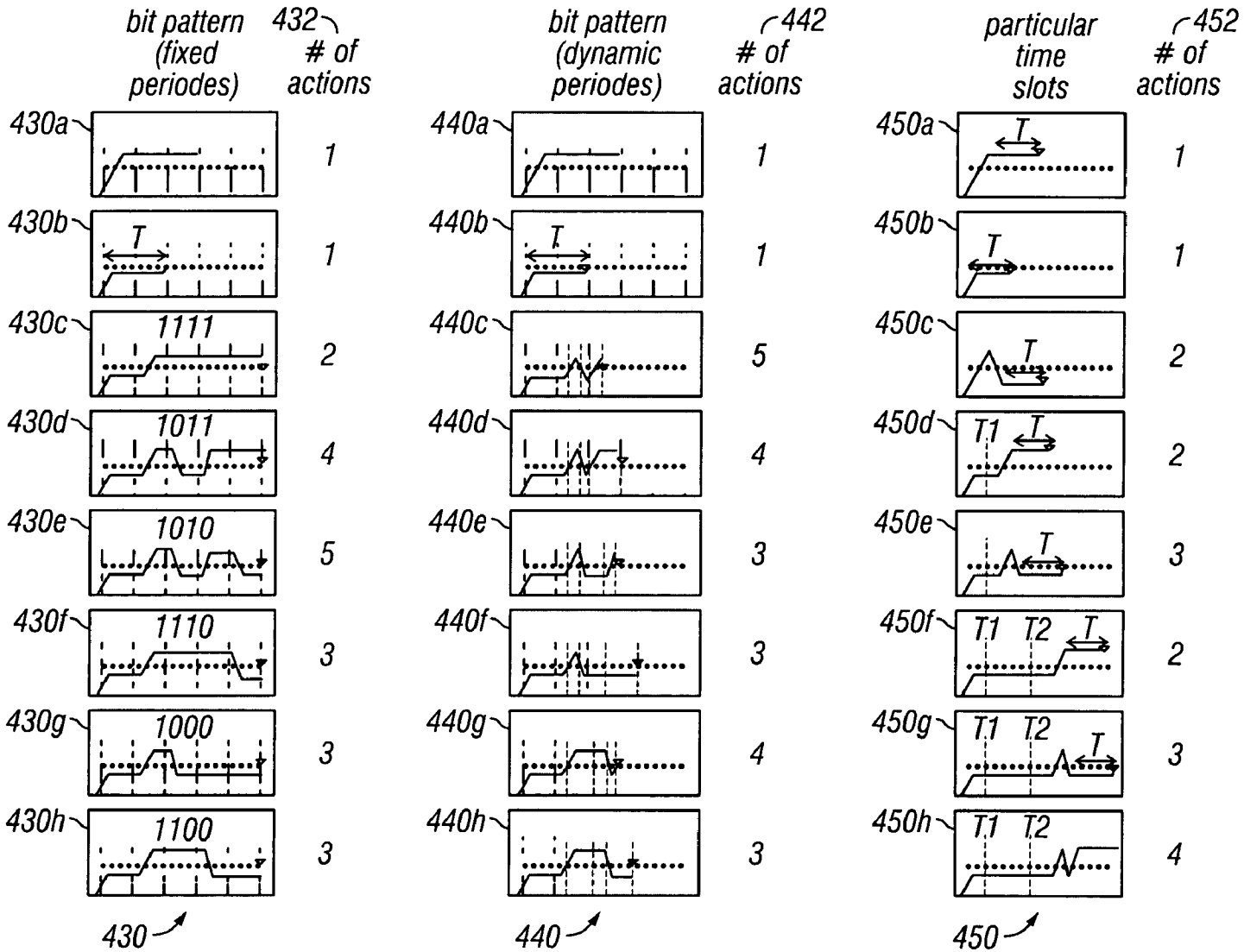

FIG. 4 provides a downlink matrix 400, which shows certain examples of flow rate schemes, any one of which may be utilized for counting pulses for the purpose of this invention. Other similar or different flow rate schemes may also be utilized. In the example of FIG. 4, the left column 490 shows the above-noted eight exemplary commands that are to be sent from the surface to the downhole by varying the flow rate at the surface. Column 410 shows a simple threshold-crossing scheme, similar to the one described in reference to FIG. 3.

Graphs 410*a*-410*i* show pulse counts from one to seven. For example, in graph 410*a*, the flow rate measurement parameter, such as voltage, crosses the threshold (dotted line) once followed by the locking time T. The signal represented by one count followed by the locking time is designated as the "continue" command 491. In graph 410*b*, the flow rate measurement parameter crosses the threshold once preceded by a constant low flow rate for a period T. Similarly 410*c*-410*i* show 2-7 crossings respectively, each such sequence followed by the locking time T. This assignment of commands to the particular sequences is arbitrary. Any suitable command may be assigned to any given sequence. The number of pump actions or the actions taken by a flow control device for the flow rate changes at the surface for each of the command signals (491-498) of column 490 are listed in column 412. For example, for the command "continue" (491), the corresponding signal includes one crossing and a single flow change action. Commands 492-498 respectively show 2-7 surface flow change actions, each such action providing a measurable signal crossing downhole.

The graphs of column 420 show an alternative threshold counting scheme wherein the pump or the flow control device at the surface changes the flow once preceded by a predefined time interval that is a multiple of a fixed time T, except for the 410*a* pulse, where the time T is essentially zero. The graph 420*b* shows one crossing preceded by the time T, while graphs 420*c*-420*h* show a single crossing preceded by times of 2T, 3T, 4T, 5T, 6T and 7T respectively. As noted earlier, the pulse scheme of column 420 can be implemented by a single action of the pump or the flow control device at the surface, as shown in Column 422.

The graphs of column 430 show an example of a bit pattern scheme that is based on fixed time periods that may be utilized to implement the methods of present invention. The graphs 430*a* and 430*b* are similar in nature to graphs 410*a* and 410*b*. In graph 430*a*, the pulse crossing is shown followed by two time periods of constant flow rate, while the graph 430*b* shows a single low flow rate for one time period followed by a crossing. The pulse scheme shown in each of the graphs 430*a* and 430*b* utilizes one flow change action at the surface, as shown in column 432. However, graph 430*c* shows a flow rate change in a first time period providing a first upward crossing followed by three successive constant counts of time periods without a crossing, i.e., constant flow rate. The bit pattern for the flow rates shown in graph 430*c* may be designated as a bit sequence "1111," wherein the first crossing is a designated as bit "1" and each time period subsequent to the upward crossing is designated as a separate bit "1." Graph 430*d* shows a first crossing (bit "1") similar to the crossing of graph 430*c* that is followed by a second crossing (designated as bit "0" as it is in the direction opposite from the first crossing) in the next fixed period and again followed by a third crossing (i.e. bit 1 as it is in the direction of the first crossing) in the following fixed time period. The third crossing is shown followed by a fixed time (bit "1"). Thus, the bit count for the pulse sequence of graph 430*d* is designated as "1011." Similarly, graph 430*g* will yield a bit scheme of "1000", wherein the first crossing is bit "1" followed by a second downward crossing and two successive fixed time periods of constant low flow rate, each corresponding to a bit "0." Thus, the scheme shown in the graphs 430 provides bit schemes based on the number of crossings and the time periods of constant flow associated with the crossings. Such a scheme can be easily deciphered or decoded downhole. In the example of the pulse scheme of graph 430, the beginning of each count is shown preceded by a low flow rate. The corresponding number of surface actions for each of the signal is shown in column 432. For example, the signal of graph 430*c* corresponds to two actions, one for the low flow rate and one for the high flow rate, while the signal corresponding to graph 430*e* corresponds to five actions, one action for the low flow rate and a separate action for each of the four crossings.

The graphs of column 440 show a bit pattern that utilizes dynamic time periods instead of the fixed time periods shown in the graph of column 430. The number of surface actions that correspond with the flow rate changes are listed in column 442. The graphs 440*a* and 440*b* are the same as graphs 430*a* and 430*b*. Graph 440*c*-440*h* bit patterns where dynamic time periods are associated with the threshold crossings. In the examples of graphs 440*c*-440*h*, at each threshold crossing a time period stars. If there is no crossing, there is a maximum predefined time period, which then represents a bit, for example bit "0." If there is a crossing within a defined time period, then that crossing may be represented by the other bit, which in this case will be bit "1." Thus, the crossings and associated dynamic time periods may be used to define a suitable bit sequence or command.

The graphs of column 450 show a scheme wherein the number of crossings in a particular time slot defines the nature of the signal. For example, graph 450*e* shows two crossings in a first particular time slot while graph 450*g* shows two crossings in a second particular time slot. Graph 450*h* shows three crossings in the second particular time slot. By counting the crossing in particular time periods, it is feasible to assign such signals corresponding commands. The number of surface actions that correspond to the signals 450*a*-450*h* are listed in column 452. For example, the signal of graph 450*d* corresponds to two actions, one of the low constant rate and one for the higher rate, while the signal corresponding to graph 450*h* has four actions, one for the low flow rate and one for each of the three crossings. It will be noted that the above flow rate change schemes are a few examples and any other suitable scheme including any combination of the above described schemes may be utilized and further any bit scheme may be assigned to any flow rate pattern.

FIG. 5 shows a table 500 that contains the exemplary commands described above and the actions taken by the downhole tool upon receiving each of these commands from the surface. Column 510 lists the eight commands. Column 520 lists certain possible previous or current modes of operation during the drilling of a wellbore. Column 530 lists the action taken by the downhole drilling assembly in response to receiving the corresponding command. For example, if the command is "ribs off" then regardless of the mode in which the drilling assembly is operating, the downhole tool will cause the ribs not to exert any pressure on the borehole walls. Similarly, if the command sent from the surface is "add/remove walk force left" then the next mode of operation will depend upon the previous or current mode. For example, if the current mode is "inclination hold mode" then the drilling assembly will apply force to move the drilling direction to the left. However, if the current mode is "inclination hold mode (reduced walk force left)", the downhole tool will remain in the prior mode.

The system described above may utilize, but does not require, any by-pass actuation system for changing the fluid flow rate at the surface. Alternatively, mud pumps may be controlled to effect necessary flow rate changes that will provide the desired number of threshold crossings. The tool may also be programmed to receive downlink only a certain time after the fluid flow has been on. The programs are also relatively simple as the system may be programmed to look for a single threshold. Limited number of commands also aid in avoiding sending a large number of surface signals or commands through the mud.

Figure 6:
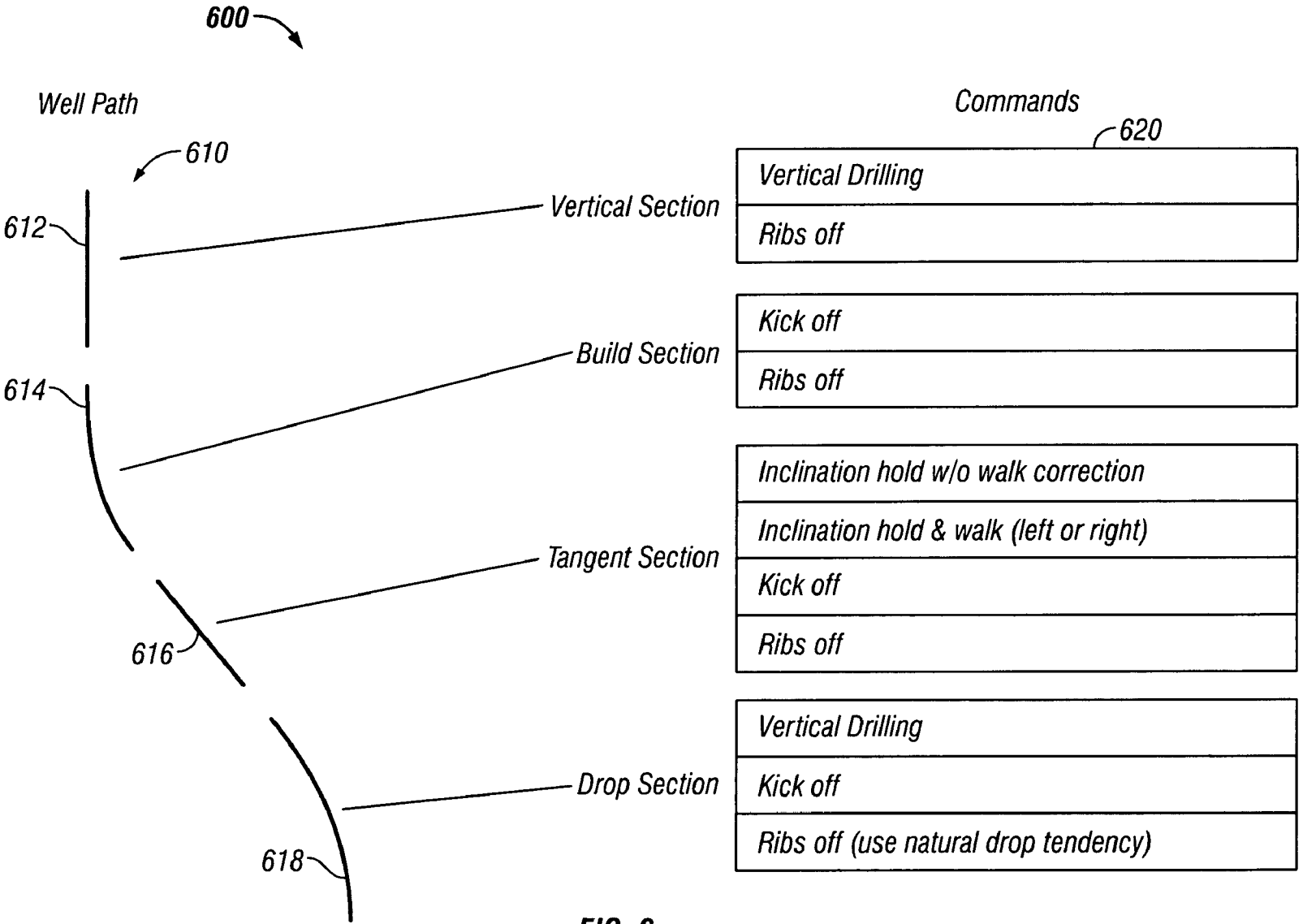
FIG. 6 shows an exemplary desired well path and a set of commands that may be utilized for drilling a well along the desired well path according to one method of the present invention.

FIG. 6 shows an example of a well path or profile 610 of a well to be drilled that can be affected by sending, as an example, six different command signals from the surface according to the method of this invention. The exemplary well profile includes a vertical section 612, a build section 614 that requires kicking off the drilling assembly to the high side, a tangent or straight inclined section 616 that requires maintaining drilling along a straight inclined path and a drop section 618 that requires drilling the wellbore again in the vertical or less inclined direction. Column 620 shows the six commands that can affect the drilling of the wellbore 610. To drill the vertical section 612, the surface telemetry controller sends a vertical drilling command such as command 498 (FIG. 4) to cause the drilling assembly to automatically keep the drilling direction vertical utilizing directional sensors in the BHA. A "ribs off" command may also be given, if it is desired that the ribs may not apply any force on the borehole walls. To drill the build section 614, the kick off command 496 may be given to activate a kick off device to a preset angle toward the desired direction. Once the drilling assembly has achieved the desired build section, an inclination hold command 497 is given. Inclination hold and walk left 494 or walk right 495 commands are given to maintain the drilling direction along the section 616. To achieve the drop section 618, a vertical drilling command is sent. Thus, six different commands based on the simple telemetry schemes described above may be utilized to drill a well along a relatively complex well path 610.

It should be appreciated that the teachings of the present invention can be advantageously applied to steering systems without ribs. Moreover, as noted previously, the present teachings can be applied to any number of wellbore tools and sensors responsive to signals, including but not limited to, wellbore tractors, thrusters, downhole pressure management systems, MWD sensors, etc. In another aspect, the drill string rotation may be changed to send signals according to one of the schemes mentioned above. The threshold value can then be defined relative to the drill string rotation. Appropriate sensors are used to detect the corresponding threshold crossings.

Thus, as described above, the present invention in one aspect provides a method that includes: encoding a command for a downhole device into a fluid pumped into a wellbore by varying a flow rate relative to a preset threshold; determining number of times the fluid flow rate crosses a selected threshold using a downhole sensor in fluid communication with the pumped fluid; decoding the command based on the number of times the fluid flow rate crosses the selected threshold; and operating the downhole device according to the decoded command.

In another aspect, a method is provided that includes: sending signals from the surface to a downhole location as a function of changing flow rate of a fluid flowing into a wellbore; detecting changes in the flow rate at the downhole location and providing a signal corresponding to the detected changes in the flow rate; determining number of times the signal crosses a threshold; and determining the signals sent from the surface based on the number of times the signal crosses the threshold. In one aspect, a plurality of signals are sent, each signal corresponding to a single change in the fluid flow rate. In another aspect, the signals are sent by changing the fluid flow rate according to a bit pattern that utilizes fixed time periods. In another aspect, the signals are sent by changing the fluid flow rate according to a bit pattern that utilizes dynamic time periods, predetermined time slots, or unique number of crossings of the threshold.

In another aspect, the invention provides a system for drilling a wellbore that includes: a flow control unit at a surface location that sends data signals by changing fluid flow rate of a drilling fluid flowing into a drill string during drilling of the wellbore; a detector in the drill string that provides signals corresponding to the change in the fluid flow rate at a downhole location; and a controller that determines the data signals sent from the surface based on number of times the signal crosses a threshold. The system includes a processor or controller that controls a pump that provides fluid under pressure or a flow control device associated with a line that supplies the fluid to the drill string to change the fluid flow rate at the surface. A downhole controller determines the signals sent from the surface based on time periods associated with crossings of the fluid flow of a threshold. The time periods may be a fixed time periods, dynamic time periods or based on selected time slots. The downhole controller correlates the determined signals with commands stored in memory associated with the controller. The controller also controls a steering device or another downhole tool according to the commands during drilling of the wellbore. In one aspect, the commands include: a command for drilling a vertical section; drilling a build section; drilling a tangent section; drilling a drop section; measuring a parameter of interest; instructing a device to perform a function; turning on a device; and turning off a device.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A telemetry method, comprising:

sending a plurality of signals from a surface location to a downhole location by changing flow rate of a fluid flowing into a wellbore, wherein each signal is represented by a particular number of times the flow rate crosses a threshold (number of crossings) and an associated time period that is one of: (i) that follows the number of crossings, and (ii) that precedes the number of crossings;

detecting changes in the flow rate of the fluid at the downhole location;

counting number of times the detected changes in the flow rate of the fluid at the downhole location crosses the threshold; and determining the signals sent from the surface based on the counted number of times the flow rate of the fluid crosses the threshold and the associated time period.

2. The method of claim 1, wherein the number of crossings is the same and the time period that precedes the number of crossings is different for each of the plurality of signals sending signals.

3. The method of claim 1, wherein the number of crossings is different and the time period that follows the number of crossings is the same for each of the plurality of signals.

4. The method of claim 1, wherein sending the plurality of signals includes changing the fluid flow rate by controlling a flow control device at the surface location.

5. The method of claim 1, wherein sending the plurality of signals includes changing the fluid flow rate by controlling a mud pump at the surface location.

6. The method of claim 1, wherein each signal corresponds to a command signal for a downhole assembly.

7. The method of claim 1, wherein detecting changes in the flow rate of the fluid includes measuring one of: fluid flow rate; and pressure.

8. A system for drilling a wellbore, comprising:

a flow control unit at a surface location that sends a plurality of signals by changing fluid flow rate of a drilling fluid flowing into a drill string during drilling of the wellbore, wherein each signal sent from the surface is represented by a particular number of times the flow rate crosses a threshold and an associated time period that is one of: (i) that follows the particular number of times the flow rate crosses the threshold, and (ii) that precedes the particular number of times the flow rate crosses the threshold;

a detector that provides signals corresponding to the changes in the fluid flow rate at a downhole location; and a controller configured to count the signals sent from the surface based on the number of times the signals cross the threshold and the associated time period.

9. The system of claim 8, wherein the flow control unit includes a processor that controls one of: a pump that provides the fluid under pressure; and a flow control device associated with a line that supplies the fluid to the drill string.

10. A telemetry system, comprising:

a flow control unit at a surface location that sends a plurality of signals by changing fluid flow rate of a drilling fluid flowing into a drill string, wherein each signal corresponds to a command and is represented by at least one crossing of a threshold by the fluid flow rate and a particular number of associated time periods that are one of: (i) that follows the at least one crossing of the threshold by the fluid flow rate, and (ii) that precedes the at least one crossing of the threshold by the fluid flow rate;

a detector downhole configured to provide signals corresponding to the at least one crossing of the threshold; and a controller configured to count the time periods associated with the at least one crossing and the command based on the number of the counted time periods associated with the at least one crossing.

11. The system of claim 10, wherein each associated time period is one of: (i) fixed time period, and (ii) dynamic time period.

12. The system of claim 8, wherein the controller determines the signals sent from the surface by comparing the number of crossings and the associated time periods with commands stored in a memory associated with the controller.

13. The system of claim 12, wherein the controller further controls a steering device in a downhole tool carried by the drill string in response to at least one command to drill the wellbore along a selected path.

14. The system of claim 13, wherein at least one command corresponds to one of: drilling a vertical section; drilling a build section; drilling a tangent section; drilling a drop section; measuring a parameter of interest; instructing a device to perform a function; turning on a device; and turning off a device.

15. The system of claim 8, wherein the detector is one of a pressure sensor and flow measuring device.

16. A tool for use in drilling a wellbore, comprising:

a bottomhole assembly (BHA) conveyable in the wellbore by a tubing that receives fluid from a surface location during drilling of the wellbore;

a sensor that detects changes in flow rate of the fluid at a location in the wellbore and provides signals corresponding to the changes in the flow rate; and a processor that counts number of crossings of the signals of a threshold value and time periods associated with the crossings to determine signals sent from the surface, wherein each signal sent from the surface is represented by a particular number of times the flow rate crosses the threshold and the associated time periods, and wherein the associated time periods are one of: (i) that follows the particular number of times the flow rate crosses the threshold, and (ii) that precedes the particular number of times the flow rate crosses the threshold.

17. The tool of claim 16, wherein the processor determines commands associated with each of the signals received from the surface from data stored in a memory associated with the processor.

18. The tool of claim 17, wherein the BHA further includes a steering device and wherein the processor controls the steering device according to at least one command to drill the wellbore along a selected path.

19. The tool of claim 17, wherein the sensor is one of a pressure sensor and a flow measuring device.

20. A method for controlling a downhole device comprising:

encoding a command for the downhole device into a fluid pumped into a wellbore by varying a flow rate relative to a threshold, wherein the command corresponds to a particular number of times the fluid rate crosses the threshold and an associated time period that is one of: (i) that follows the particular number of times the flow rate crosses the threshold, and (ii) that precedes the particular number of times the flow rate crosses the threshold;

counting number of times the fluid flow rate crosses the threshold and the time period associated with the number of crossings using a downhole sensor in fluid communication with the fluid;

decoding the command based on the number of times the fluid flow rate crosses the threshold and the associated time period; and operating the downhole tool according to the decoded command.

21. The method of claim 1 further comprising associating each determined signal with a command selected from a plurality of commands stored in a tool in the wellbore.

22. The method of claim 21, wherein the selected command is selected from a group consisting of: (i) drilling a vertical section; (ii) drilling a build section; (iii) drilling a tangent section; (iv) drilling a drop section; (v) measuring a parameter of interest; (vi) instructing a device to perform a function; (vii) turning on a device; and (viii) turning off a device.

* * * * *

UNITED STATES PATENT AND TRADEMARK OFFICE

CERTIFICATE OF CORRECTION

PATENT NO. : 7,518,950 B2
APPLICATION NO. : 11/386622
DATED : April 14, 2009
INVENTOR(S) : Joachim Treviranus, Henning Doerge and Marc Kurella It is certified that error appears in the above-identified patent and that said Letters Patent is hereby corrected as shown below:

Column 10, claim 2, lines 57 and 58, delete "sending signals"

Signed and Sealed this

Nineteenth Day of May, 2009

John Doll

JOHN DOLL
*Acting Director of the United States Patent and Trademark Office*